US006223862B1

(12) United States Patent
Barnes

(10) Patent No.: US 6,223,862 B1
(45) Date of Patent: May 1, 2001

(54) ELEVATOR CABLE TENSIONING DEVICE AND METHOD

(76) Inventor: Michael Barnes, 4257 Apex Dr., Las Vegas, NV (US) 89147

( * ) Notice: Subject to any disclaimer, the term of this patent is extended or adjusted under 35 U.S.C. 154(b) by 0 days.

(21) Appl. No.: 09/336,119

(22) Filed: Jun. 17, 1999

(51) Int. Cl.[7] ..... B66B 5/00; B66B 7/08; B66B 7/10

(52) U.S. Cl. ..... 187/412

(58) Field of Search ..... 187/411, 412, 187/346, 347, 266, 264

(56) References Cited

U.S. PATENT DOCUMENTS

| | | | | |
|---|---|---|---|---|
| 124,952 | | 3/1872 | Hanford | 187/412 |
| 716,950 | * | 12/1902 | Slevin | 187/346 |
| 1,323,357 | * | 12/1919 | Evans | 187/412 |
| 1,418,089 | | 5/1922 | Linquist | 187/412 |
| 1,516,727 | | 11/1924 | Hawkins | 187/412 |
| 1,632,083 | * | 6/1927 | Kieckhefer | 187/412 |
| 1,835,032 | * | 12/1931 | Evans | 187/412 |
| 1,852,155 | * | 4/1932 | Evans | 187/412 |
| 1,869,471 | * | 8/1932 | Eggan | 187/412 |
| 1,881,459 | | 10/1932 | Frost | 187/412 |
| 1,991,538 | | 2/1935 | Beatty | 187/412 |
| 2,001,007 | | 5/1935 | Wilson | 187/412 |
| 2,180,491 | | 11/1939 | Wilson | 187/412 |
| 2,385,488 | | 9/1945 | Beatty | 187/412 |
| 4,537,286 | | 8/1985 | Morris | 187/412 |
| 5,353,893 | | 10/1994 | Sun | 187/412 |
| 5,526,901 | * | 6/1996 | Salmon | 187/412 |
| 5,611,412 | | 3/1997 | Yoo | 187/412 |
| 5,641,041 | * | 6/1997 | Masuda et al. | 187/347 |
| 6,065,569 | * | 5/2000 | Fuller | 187/412 |

FOREIGN PATENT DOCUMENTS

| | | | | |
|---|---|---|---|---|
| 2147558 | * | 5/1985 | (GB) | 184/412 |
| 404164791 | * | 6/1992 | (JP) | 187/412 |
| 405032385 | * | 2/1993 | (JP) | 187/412 |
| 405039181 | * | 2/1993 | (JP) | 187/412 |
| 405201652 | * | 8/1993 | (JP) | 187/347 |
| 000772966 | * | 10/1980 | (SU) | 187/412 |

* cited by examiner

*Primary Examiner*—Eileen D. Lillis
*Assistant Examiner*—Paul T. Chin
(74) *Attorney, Agent, or Firm*—Quirk & Tratos

(57) ABSTRACT

A device and method are set forth for tensioning elevator cables. The device includes a platform supporting a plurality of hydraulic cylinders each adapted to be coupled to a thimble rod for a cable. Hydraulic fluid is supplied to each cylinder at the same pressure until each cable load is transferred from the cable system hitch plate to the platform indicating that each cable is now under the same tension. The thimble rods are adjusted with the cables now at the same tension and the hydraulic fluid is vented from the cylinders to transfer the cable loads back to the hitch plate.

5 Claims, 5 Drawing Sheets

ELEVATOR CABLE TENSIONING DEVICE AND METHOD

FIELD OF THE INVENTION

The present invention relates to devices and methods for tensioning cables in an elevator hoist system.

BACKGROUND

Elevator cars, which are roped or cabled in a 2:1 configuration, are supported by wire cables which terminate at each end in thimble rods which are attached to supporting hitch plates located at the top of the elevator hoist way and supported by the building structure. With reference to FIG. 1, a typical roping for an elevator car is shown. As shown and described hereinafter, from the supporting hitch plate located above the elevator car, the cables pass under a sheave attached to the elevator car, over a traction drive and guide sheave, under a sheave attached to a counterweight and then back to a second hitch plate located above the counterweight.

As is known, the cables and drive sheaves wear and the cables stretch through normal use. The stretching lengthens the cables which means that certain cables must slip around the sheaves and pulleys to keep up with other cables which may stretch at a different rate. This wears on the traction surfaces of the traction drive sheaves and other sheaves in the system.

If the cable tension is not occasionally adjusted, and the wear and stretching become severe, the entire cable system including the sheaves must be "re-roped." This requires that the elevator car be taken out of service for a period of time inconveniencing the buildings customers. Further the labor and equipment costs involved in "re-roping" an elevator system are high. Hence it is known to provide periodic service to monitor and adjust the tension of the cables in the elevator system.

One technique to measure the tension of an elevator cable involves a device that hooks onto the cable and by bending the cable measures the cables tension. To adjust the tension of the cables to be substantially equal, the serviceman would measure the tension and adjust each cable at the hitch plate by adjusting the position of the thimble rods relative thereto until each cable tension is substantially the same, i.e. the load carried by each cable is substantially equal. Once the cable tension is adjusted, the car is cycled up and down and the tension checked again to make sure that the tension for the cables is substantially equal. As can be appreciated, this procedure is time consuming and is not entirely accurate.

Another technique is to "pluck" the cables and measure the wave oscillations of the cable which are related to the cables tension. By adjusting the cables in the manner described above and checking the tension, the tension for all cables in the system can be equalized. Again this is time consuming and not highly accurate. Further, whichever technique is used, usually the elevator car must be cycled up and down after each adjustment and the cable tension tested again to confirm that the tensions are substantially equal.

To attempt to resolve the drawbacks noted above, it has been known to install permanent cable tension equalizing mechanisms at the coupling of the thimble rods to the hitch plates. One such example is described in Beatty, U.S. Pat. No. 2,385,488 which uses a hydraulic cylinder in the hitch assembly to connect the elevator cables to the building support structure. Beatty requires that the hydraulic cylinder remain in service and become a permanent part of the hitching assembly which increases the cost of the elevator cable systems. Furthermore, for those systems which were not installed with hydraulic tension equalizers, retrofitting can be expensive, time consuming and may be, depending upon the application, inappropriate.

Other similar approaches to addressing the problem of elevator cable tension by a permanent tension equalizing device are described in Wilson, U.S. Pat. No. 2, 001,007, Hawkins, U.S. Pat. No. 1,516,727.

There is a need for a device and method which can be used to easily and quickly to adjust the tension of elevator cables without replacing or requiring elaborate hitching assemblies. More particularly, there is a need for a device and method which is portable and can be used by service personnel on existing and varying hitching assemblies to quickly and easily adjust cable tension.

SUMMARY OF THE INVENTION

There is, therefore, set forth according to the present invention, a cable tensioning device and method which is portable, is adapted to be coupled to a variety of existing cable hitching assembly configurations and which can be used to easily, accurately and quickly adjust cable tension in an elevator cable system.

The device according to the present invention includes a stand having a platform adapted to be disposed and located above the elevator cable hitching assembly and its thimble rods. A plurality of hydraulic cylinders is disposed and supported on the platform, each cylinder coupled to a thimble rod. Means are provided for supplying pressurized hydraulic fluid to the hydraulic cylinders at substantially equal pressure to impose an equal force upon each cable until the load on each cable is transferred from the hitching assembly to the stand and each cable is under substantially the same tension. At this point, an adjustment is made to secure the thimble rods to the hitching plate while the rods are at substantially equal tension. Thereafter, the hydraulic cylinders are depressurized transferring the load back from the stand to the hitching assemblies. At this point, each of the elevator cables is at substantially the same tension.

If desired, the elevator car may be cycled while the load is being carried by the stand to assure that each of the cables is at substantially the same tension.

The method according to the present invention includes attaching to each thimble rod a hydraulic actuator supported by a stand. Hydraulic fluid is supplied to each actuator to impose an equal force upon the cable to transfer the load from the hitch plate to the stand. Thereafter, each cable is adjusted to the hitch plate while the cables are at substantially equal tension and thereafter the hydraulic fluid is vented from the actuators to transfer the cable load back to the hitch plate. The actuators are then disconnected form the rods.

As can be appreciated, the device and method can be embodied as a small, portable unit taken by the serviceman to the elevator room and used to quickly and accurately adjust the tension of cables in an elevator cable system.

BRIEF DESCRIPTION OF THE DRAWINGS

These and other features and advantages will be appreciated as the same becomes better understood with reference to the specification, claims and drawings wherein:

DESCRIPTION

Figure 1:
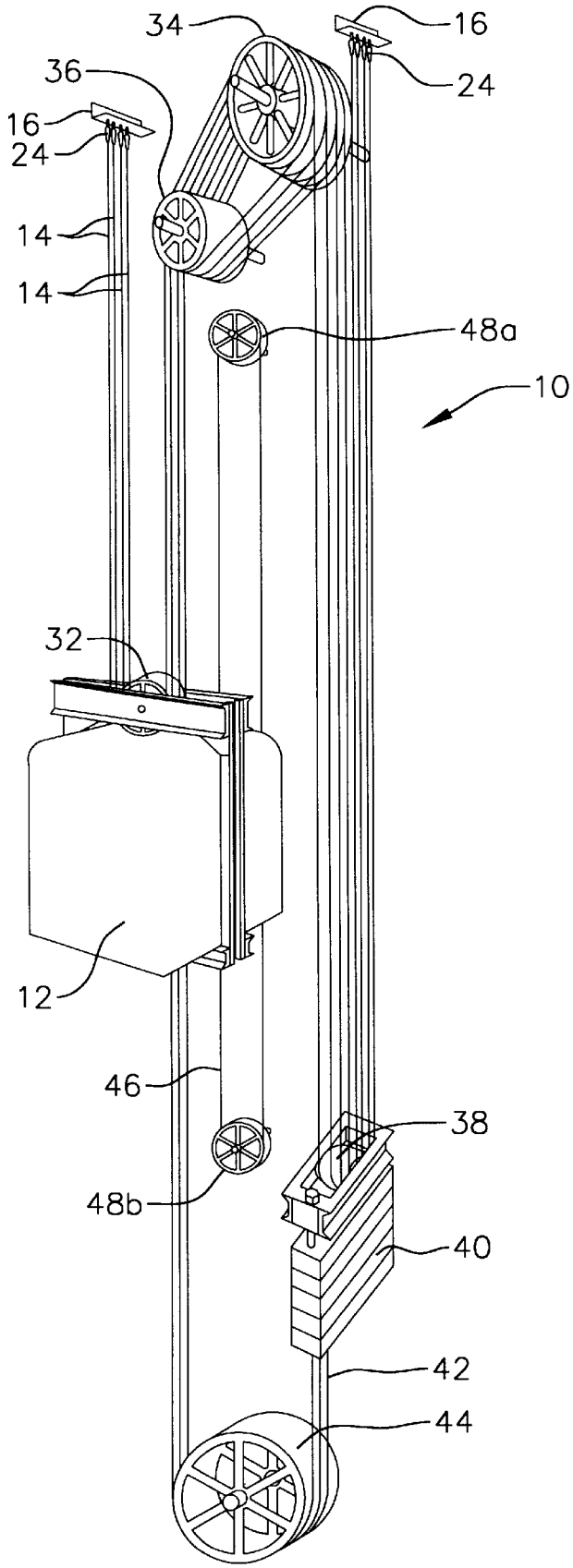
FIG. 1 illustrates a typical 2:1 "roping" or cable system for an elevator car.

Turning to FIG. 1, a typical elevator cable system 10 roping an elevator car 12 in a 2:1 configuration is shown. The cable system 10 of FIG. 1 shows four cables 14 routed in the manner as hereinafter described. In that the cables 14 of the cable system are each routed in the same manner, only one cable 14 will be described.

Figure 3:
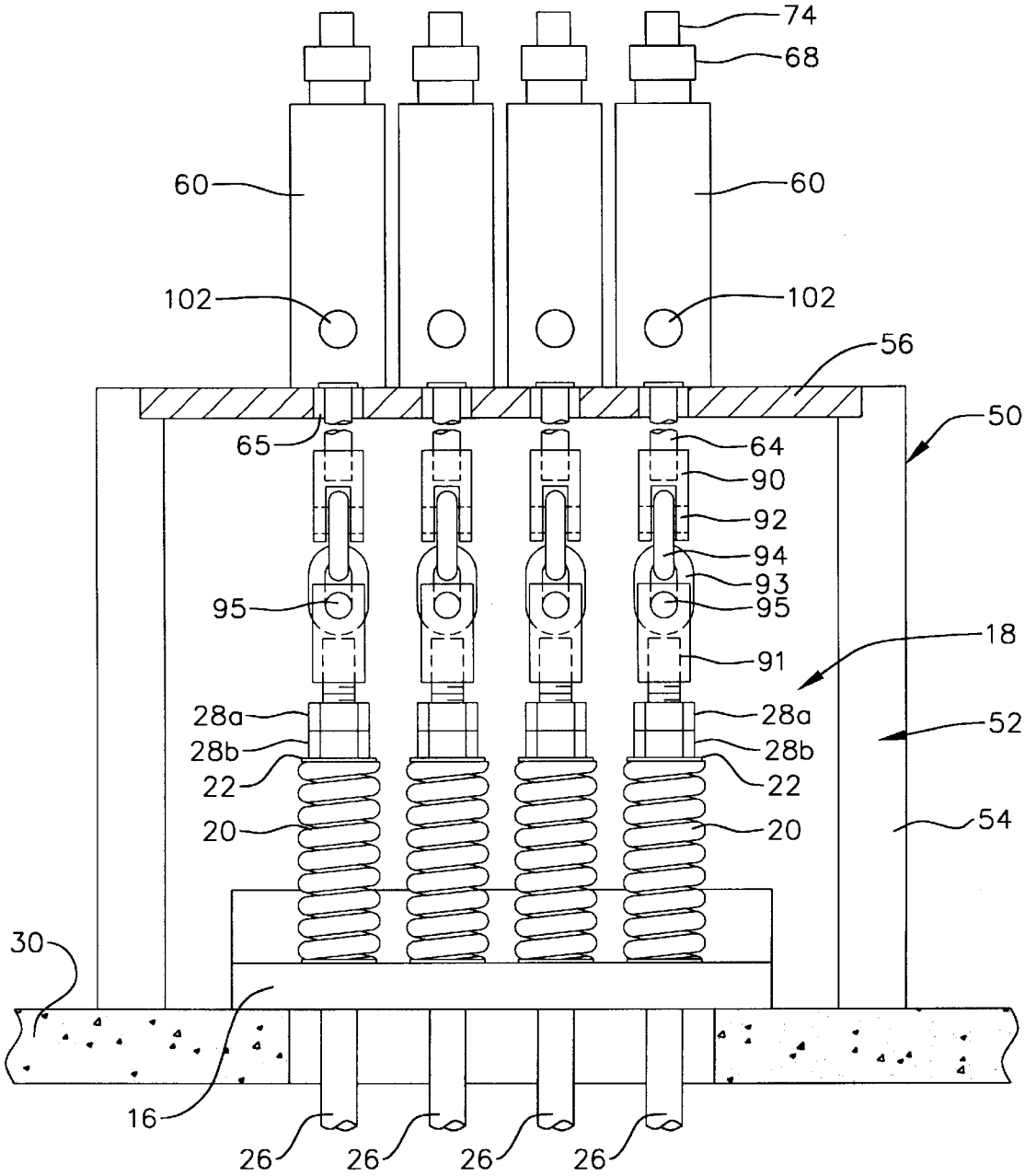
FIG. 3 is a side view of the device of FIG. 2.

At one end, each cable 14 is secured to a hitch plate 16 typically through a hitching assembly 18 (not shown in FIG. 1). With reference to FIG. 3, a typical hitching assembly 18 includes a spring 20 having one end bearing on the hitch plate 16. On the other end of the spring 20 is a washer 22. Through the washer 22, the tension of each cable 14 is transferred through the spring 20 to the hitch plate. The springs 20 act to equalize the tension on the cables 14 and, to a degree, dampen any oscillations which may occur in the cable system 10. Each of the cables 14 has coupled to its ends by shackles 24 (FIG. 1) a threaded thimble rod 26. At the hitch plate 16, the rods 26 extend upwardly through the springs 20 and washers 22 to threadably receive a pair of nuts 28*a,b*. The bolts 28*a,b* are tightened down on the washers 22 to adjust the tension of the cables 14 in a manner known in the art. Thus the tension of the cables 14 is transferred through the rods 26 to the bolts 28*a,b*, washers 22 and springs 20 to the hitch plate 16. The hitch plate 16 is, in turn, coupled to the building superstructure as by being coupled to a concrete reinforced floor 30 in an elevator room servicing the cable system 10.

Returning to FIG. 1, the cables 14 extend from the hitching assembly 18 downwardly through a first sheave 32 secured to the top of the elevator car 12. The cables 14 from the first sheave 32 extend upwardly and are wrapped about a traction sheave 34 and guide sheave 36. The traction sheave 34, in a manner known in the art, is driven by a motor for raising and lowering the elevator car 12. From the traction sheave 34, the cables 14 extend downwardly to pass about a second sheave 38 coupled to a counterweight 40 and back up to another hitch assembly 18 coupling the other end of the cables 14 to a hitch plate 16 in a manner described above.

The counterweight 40 is in turn attached by compensating cables 42 about a third sheave 44 to the elevator car 12. Also included in the cable system 10, in a manner well known in the art, are governor ropes 46 disposed about governor sheaves 48*a,b*.

The cable system 10 described above, may experience stretching of the cables 14 during service. The stretching extends the lengths of some cables 14 in the cable system 10 which has two adverse affects. First, is that where some cables 14 are longer than others, they must slip to maintain contact with the various sheaves of the cable system 10 increasing wear upon the cables 14 and the sheaves. As wear increases, the service life of the components is significantly reduced and if the stretching is sufficient enough over a long period of time, may required replacement of the sheaves as well as the cables 14. Replacement requires removing the elevator car 12 from service and can be expensive in labor and equipment costs. A second effect is that the stretching of some cables 14 will result in the unequal application of loads, e.g. tension on the cables 14 accelerating stretching and wear. Thus, it is important to maintain the cables 14 at substantially equal tension. By maintaining the cables 14 at equal tension, the lengths of the cables 14 and the cable system 10 are maintained substantially the same as are the loads carried thereby.

Furthermore, it should be understood that while a certain type of hitching assembly 18 is described, that cable systems 10 may have a varying arrangement of cable arrangements and hitching techniques, thus any device or method used for tensioning cables must be substantially universal.

Figure 2:
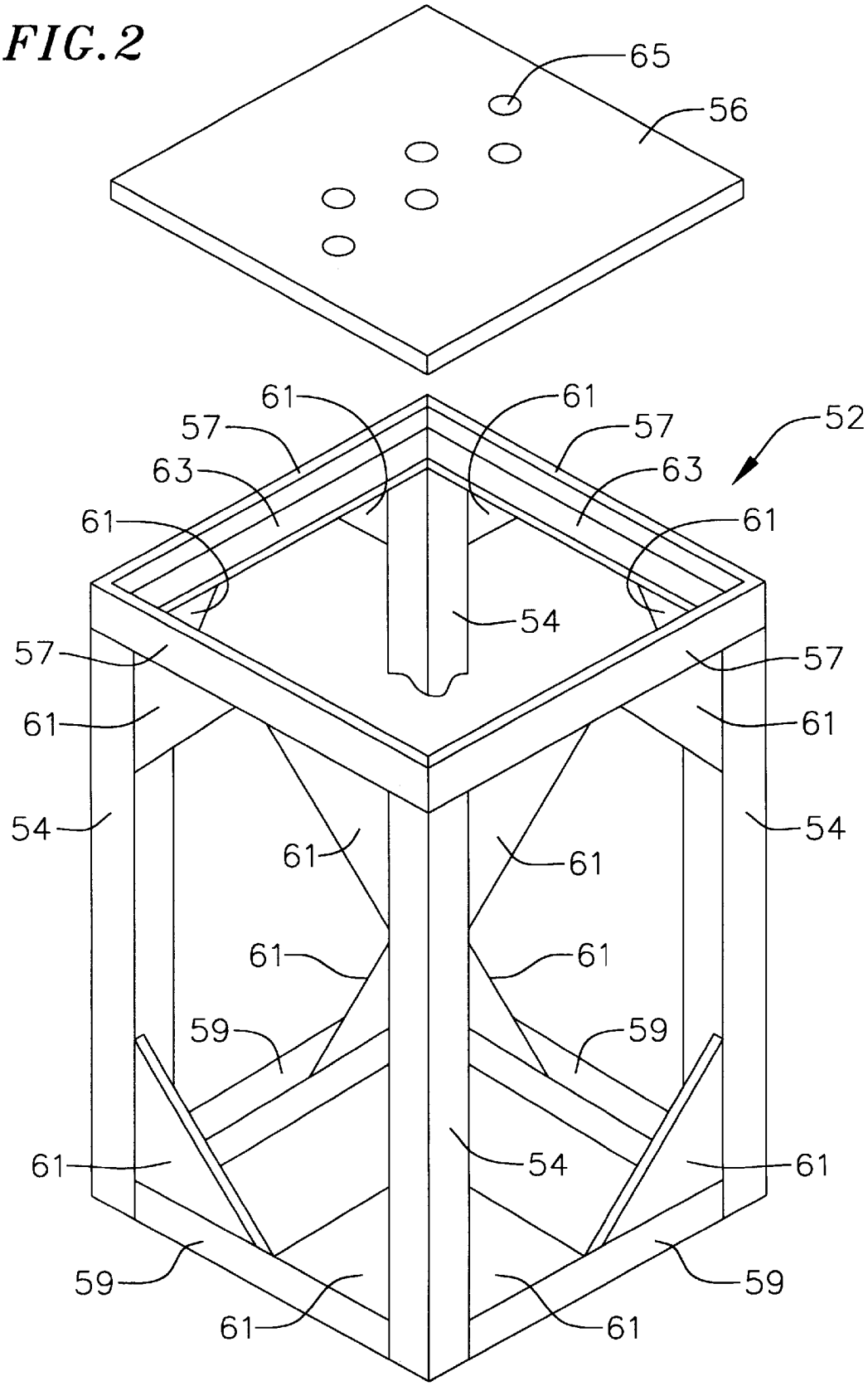
FIG. 2 is a front view of the device according to the present invention shown connected to the elevator cable thimble rods and the hitching assembly for the cables.

Turning to FIGS. 2 and 3, the device 50 according to the present invention for tensioning cables and method will now be described.

The device 50 includes a stand 52 having four legs 54 adapted to rest on the floor 30 and support there above a platform 56. The legs 54 and platform 56 may be fashioned from steel or the like and must have a strength sufficient to support the loads carried by the cables 14 at the hitch plates 16. As shown in the drawings, the platform 56 may be defined by cross members interconnected between the legs 54.

Figure 4:
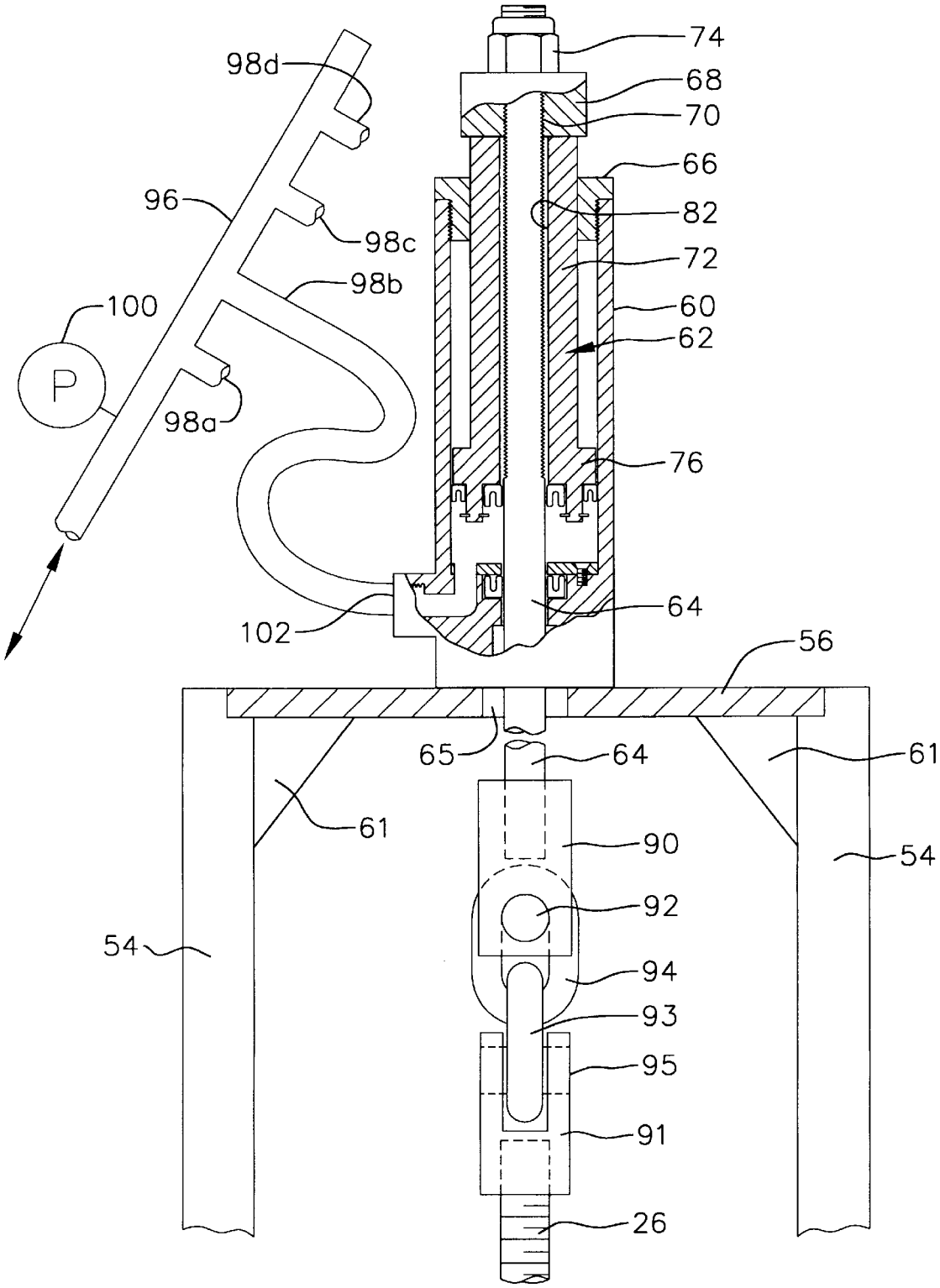
FIG. 4 is a side view of the device of FIG. 3 and showing the connection to pressurized hydraulic fluid.
Figure 5:
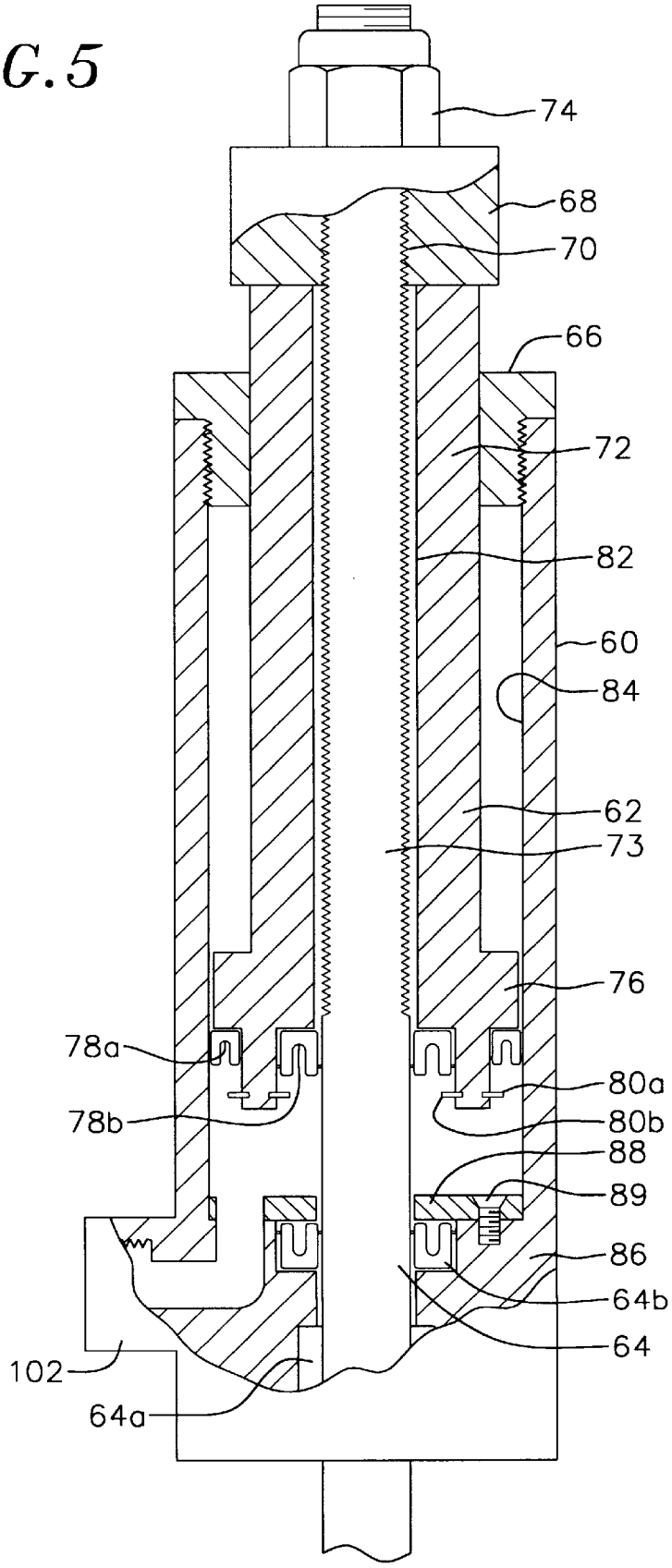
FIG. 5 is a side section view of a cylinder for use in the device.

Supported by the stand 52 at the platform 56 are a plurality of hydraulic actuators shown in FIGS. 4 and 5 as hydraulic cylinders 60 each including a hydraulically driven piston 62. The piston 62 has a shaft 64 which extends from the hydraulic cylinder 60 for connection to a rod 26. As shown in FIG. 5, the piston shaft 64 extends through a seal 64*b* in the cylinder 60. The piston 62 has a head 76 and an axially extending cylindrical body 72 with an axial bore 82 to receive the piston shaft 64 as shown in FIG. 5. As shown in FIG. 5, the body 72 extends from the cylinder 60 through an end cap 66 threaded to and closing one end of the cylinder 60. At its end the piston 62 has threaded thereto a receiver 68 including an axial, treaded bore 70 to threadably pass a threaded portion 73 of the piston shaft 64. To fix the piston shaft 64 relative to the receiver 68 and piston 62 a nut 74 is threaded over the threaded portion 72. Resilient seals 78*a,b* held by locking rings 80*a,b* seal the head 76 inside the cylinder 60 and the piston shaft 64 passing therethrough. An axial bore 82 through the piston 62 and head 76 passes the shaft 64 therethrough. A guide 64B is disposed opposite the cap 66 to guide the movement of the shaft 64.

To couple the hydraulic cylinders 60 to the stand 52, any suitable technique may be used. The platform 56 is a variable configuration item that aligns the cylinders 60 with the existing hitch plate 16 by positioning the holes 65 in substantially the same pattern and spacing as the thimble rods 26 as presented at the hitch plate 16. As hereinafter described, the variable configuration provided by the platform 56 enables the device to accommodate different positions at which the rods 26 are presented at the hitching assemblies 18. As shown in FIG. 3, the stand 52 may include brace plates 61 secured to cross members 57. Each hydraulic cylinder 60 maybe, in turn, secured by fasteners to the brace plates 78 to couple the hydraulic cylinders 60 to the stand 52.

To supply and vent hydraulic fluid from each of the hydraulic cylinders 60, a manifold 96 is provided through which hydraulic fluid is communicated by individual conduits 98*a–d* to each of the hydraulic cylinders 60 for driving the pistons 62 thereof. A pressure gauge 100 may be provided on the manifold 96 to sense the pressure carried thereby. As can be appreciated, since the manifold 96 supplies the pressurized hydraulic fluid through the conduits 98 to each of the hydraulic cylinders 60, that each cylinder 60 will be at substantially the same pressure. Each of the conduits 98 is coupled to a hydraulic cylinder 60 at a coupling 102.

To attach the piston shafts 64 to the thimble rods 26, each shaft 64 has at its end coupled thereto a clip 90 which receives a pin 92 to couple a chain link 94 to the clip 90. A second chain link 93 is in turn coupled to a second clip 91 by a second pin 95. The second clip 98 is threaded over the thimble rod 26 and thereafter the chain links 94, 96 are coupled between the first clip 90 and the second clip 98 to couple the piston shaft 84 to the rod 26. The clips 90, 98 and chain links 94, 93 provide, in cooperation with the platform 56, for aligning the piston shafts 64 with the thimble rods 26 as presented at the hitch plate 16.

In operation, the stand 52 is disposed over the hitching assembly 18 as suggested in FIGS. 2 and 3. The second clip 91 is threaded over the ends of the thimble rods 26 which extend upwardly past the nut 28*a,b*, washers 22 and springs 20. Thereafter the first and second chain links 94, 93 are coupled between the first clips 90 and second clips 91 to couple the rods 26 to the shaft 24 for the hydraulic pistons 62. With the elevator car 12 out of service, hydraulic fluid is supplied through the manifold 96 and conduits 98 to each of the hydraulic cylinders 60 in ever increasing pressure. Pressure can be monitored at the pressure gauge 100. As the pressure in the cylinders 60 increases, a pressure is reached for each cable 14 at which time the load carried by the hitching assembly 18 is transferred therefrom to the stand 52. This event would be denoted at such time as the nuts 28*a,b* are lifted from engagement with the washers 22. In that each of the hydraulic cylinders 60 is supplied with hydraulic fluid at substantially the same pressure, at such time as the load for each cable 14 has been transferred from the hitching assembly 18 to the stand 52, the operator knows that each of the cables 14 is now at substantially the same tension. At this position, if desired, the car 12 may be cycled several times to assure that the tension is equalized along the length of the cables 14 and that the tension for each of the cables 14 witnessed at the hydraulic cylinders 60 is substantially the same. The nuts 28*a,b* are threaded downwardly along the thimble rods 26 to engage the washers 22 and compress the springs 20. A torsion wrench may be used to tighten the nuts 28*a,b* to a proper tension to just transfer the load from the stand 52 to the hitching assembly 18. The hydraulic fluid in the cylinders 60 is then vented back through the manifold 96 and the load is transferred back to the hitching assemblies 18. Each of the cables 14 now experiences the same tension and is at substantially the same length reducing wear upon the components of the cable system 10.

It is to be understood that other types of connecting means may be used to connect the hydraulic cylinders 60 to the cables 14. Further it should be understood that operative positions of the hydraulic cylinders 60 and pistons 62 may be reversed with the pistons secured to the stand 52 and the hydraulic cylinders 60 moveable relative to the stand 52 to transfer the loads from the hitching assemblies 18 to the stand 52. Further, as stated above, each of the hydraulic cylinders 60 may be gimbaled to the stand 52 to conform to the angles at which the cable thimble rods 26 make at the hitching assemblies 18.

Where the hitch plates 16 are disposed below the floor 30 on beams, additional support may be required for the stand 52 to transfer the cable loads through the stand 52 to the building structure.

While I have shown and described certain embodiments of the present invention, it is to be understood that it is subject to many modifications and changes without departing from the spirit and scope of the appended claims.

I claim:

1. In a tensioning apparatus useful in tensioning a plurality of cables of an elevator cable system relative the elevator support structure, each said cable terminating in a threaded rod at one end thereof extending through a corresponding opening in a hitching plate affixed to said elevator support structure and through the interior of a corresponding helical spring mounted on the opposite side of said hitching plate secured in suspension by an adjustment nut threadably engaged to said rod and advanced to compress the distal ends of each said spring, the improvement comprising:

a platform operatively supported on said hitching plate in alignment above the free ends of said rod;

a plurality of hydraulic cylinders mounted on said platform each in substantial alignment above a corresponding one of said rods, each cylinder including a piston hydraulically displaced in the corresponding one of said cylinders;

a plurality of connector assemblies each including a connector threadably engaged to a free end a corresponding one of said rods and a coupler pivotally connected between said connector and a corresponding one of said pistons for limiting lateral loads thereto;

a source of hydraulic fluid at pressure; and manifold means connected between said source and each said hydraulic cylinder for applying substantially equal hydraulic pressure to each said piston whereby substantially equal load is transferred from each said rod to said platform to allow threaded adjustment of each said nut relative the corresponding one of said springs.

2. Apparatus according to claim 1 wherein:

said connector includes a pin and said coupler includes at least one link engaged to a corresponding one of said pistons and pivotally connected to said pin.

3. Apparatus according to claim 2 wherein:

each said cylinder is adjustably supported on said platform for substantial axial alignment relative the corresponding ones of said rods.

4. A method for adjusting the spring tension pre-load that is applied to each of the several cables of an elevator cable system, each said cable including a threaded rod at one end thereof each inserted through a corresponding opening in a hitching plate to pass through the interior of a helical spring mounted on the opposite side of said plate, and a nut threadably advanced on each said rod against each said spring comprising the steps of:

connecting the free end of each rod to a corresponding hydraulic cylinder;

applying a common source of hydraulic pressure to each said cylinder to produce a substantially equal tensile load at the free ends of each said rod;

threadably advancing each said nut on the corresponding ones of said rods against each said spring;

relieving said common source of hydraulic pressure from said cylinder; and disconnecting each said cylinder from the corresponding ones of said rods.

5. A method according to claim 4 wherein:

said step of connecting the free ends of said rods to a corresponding hydraulic cylinder includes the further step of supporting each said cylinder above the corresponding one of said rods and engaging a plurality of connector assemblies each including a connector threadable engaged to a free end of a corresponding one of said rods and a coupler connected between said connector and a corresponding one of said cylinders for limiting lateral loads thereto.

* * * * *